United States Patent [19]

Wolf

[11] Patent Number: 4,679,389

[45] Date of Patent: Jul. 14, 1987

[54] SPINNING OR TWISTING MACHINE

[75] Inventor: Horst Wolf, Albershausen, Fed. Rep. of Germany

[73] Assignee: Zinser Textilmaschinen GmbH, Ubersbach-Fils, Fed. Rep. of Germany

[21] Appl. No.: 828,838

[22] Filed: Feb. 12, 1986

[30] Foreign Application Priority Data

Feb. 13, 1985 [DE] Fed. Rep. of Germany ..... 3504976

[51] Int. Cl.[4] ..... D01H 5/66; D01H 3/16

[52] U.S. Cl. ..... 57/304; 57/303; 57/308; 57/100

[58] Field of Search ..... 57/92, 100, 105, 300, 57/303, 304, 305, 308

[56] References Cited

U.S. PATENT DOCUMENTS

| | | | |
|---|---|---|---|
| 2,843,995 | 7/1958 | Furstenberg | 57/305 |
| 2,924,062 | 2/1960 | Sutcliffe | 57/304 |
| 3,086,348 | 4/1963 | Fowler et al. | 57/304 |
| 3,769,786 | 11/1973 | Greive et al. | 57/105 |
| 3,924,395 | 12/1975 | Grossi | 57/305 X |

FOREIGN PATENT DOCUMENTS

| | | |
|---|---|---|
| 394894 | 6/1965 | Fed. Rep. of Germany . |
| 1685890 | 12/1966 | Fed. Rep. of Germany . |
| 1254058 | 9/1967 | Fed. Rep. of Germany . |
| 369933 | 2/1983 | Fed. Rep. of Germany . |
| 2714299 | 3/1985 | Fed. Rep. of Germany . |
| 1383990 | 2/1975 | United Kingdom . |

*Primary Examiner*—Donald Watkins

*Attorney, Agent, or Firm*—Karl F. Ross; Herbert Dubno

[57] ABSTRACT

A spinning or twisting machine comprises at least one operating unit, which is driven by a drive motor mounted near an operating unit, at least one suction or air duct, a heat collecting jacket for a drive motor at least partially enclosing the drive motor, and at least one connecting air duct connecting the heat collecting jacket with at least one suction or air duct so that heat generated at the drive motor can be exhausted through the duct. The ventilators normally associated with the drive motors can be eliminated or reduced in output and energy consumption.

4 Claims, 4 Drawing Figures

SPINNING OR TWISTING MACHINE

FIELD OF THE INVENTION

My present invention relates to a machine for making spun or twisted yarn, more particularly, to a spinning or twisting machine with at least one operating unit, (e.g. spinning frame, twisting frame, drafting frame, spindle bank, traveler ring beam), which is driven by a heat-generating drive motor mounted near it.

BACKGROUND OF THE INVENTION

A spinning machine is already known, whose operating units are driven by drive motors, which develop considerable heat. The heat developed is transferred to the surroundings, which are thereby heated up. This heat causes undesirable effects in the textile product wound up on the operating units, since it has different characteristics on account of the heating and reduction of relative humidity than a product wound up on the operating units which is not heated. The heat generated by the drive motor can be controlled to some extent by a ventilator or fan. With the ventilator a more uniform heating of the entire textile machine occurs. However, ventilators are both costly and space consuming.

To conduct the cooling air from the drive motor not through the room in which the spinning machine is found, but through air ducts to the surroundings has been taught in Swiss Pat. No. 394 894. Also drawing away heat arising in the operating unit by suction has been described in Swiss Pat. No. 451 768. The independent air cooling of individual drive motors is known from German Pat. DE-PS No. 27 14 299. All these known structures are complicated and expensive causing corresponding problems in construction, use and maintenance of the spinning or twisting machine, in which they are found.

OBJECTS OF THE INVENTION

It is an object of my invention to provide an improved spinning or twisting machine which obviates the aforedescribed disadvantages.

It is also an object of my invention to provide an improved spinning or twisting machine, in which heating of its operating units or other parts by a neighboring drive motor is prevented in a simpler and less expensive way than in previous spinning or twisting machines.

It is another object of my invention to provide an improved spinning or twisting machine, in which heating of the operating units (e.g. spindles or bobbins) and the textile product wound on them is significantly reduced in a simple and inexpensive way, to prevent an increased temperature and decreased humidity from disadvantageously influencing the product properties.

It is yet another object of my invention to provide an improved spinning or twisting machine, in which the ventilator or fan normally associated with each motor can be omitted, so that a comparatively less expensive drive motor and motor-mounting structure can be used, and in which operation of the motor requires less energy consumption.

SUMMARY OF THE INVENTION

These objects and others which will become more readily apparent hereinafter are attained in accordance with my invention in a spinning or twisting machine having at least one operating unit that is driven by a drive motor mounted near an operating unit. It may also have at least one suction duct through which fiber (e.g. roving or sliver) can be drawn (usually in the event of failure at the drafting rolls).

According to my invention the drive motor is at least partially enclosed in a heat collecting jacket, which is connected by at least one connecting air duct with at least one such suction duct. The drive motor may be associated with a ventilator, but the ventilator can then have a reduced ventilator power consumption from that previously necessary. Preferably no fan is provided on the motor.

By an operating unit is meant a machine component having a high rotational speed during operation, for example, a spindle, rotor, or drafting roller.

My invention has the advantage that in a simple way the transfer of heat from the heated drive motors to the adjacent operating parts and locations, particularly where fiber is wound or packed, is prevented. By the heat collecting jacket the heat rising from the hot motor can be collected and exhausted. The air warmed in and around the drive motors no longer circulates in the room where the spinning or twisting machine is located, but is collected by the heat collecting jacket and discharged through the main suction ducts of the machine.

In spinning or twisting machines, the operating units can be associated with a fiber suction duct mechanism for transport of fiber strips, pieces, or the like. These fiber strips, pieces, or the like can be drawn in at a fiber delivery location of the rollers of a drawing frame.

They are drawn through a suction intake pipe into a main air duct.

According to my invention this main air duct of the suction duct mechanism also is used for exhausting the heat generated in the drive motor and collected in the heat collecting jacket.

Thus a simplification in the structure of the spinning or twisting machine results because the main air duct fulfills dual function. According to my invention each heat collecting jacket is connected by a connecting air passage with at least one such main air duct.

According to another feature of my invention, the heat collecting jacket is attached to the drive motor, and the drive motor and the heat collecting jacket are movable to adjust the tension on a drive belt associated with the drive motor.

In one embodiment of my invention the connecting air ducts each comprise a pipe and two flexible coupling sleeves, each end of the pipe fitting into each of the flexible coupling sleeves. In another embodiment the connecting air ducts each comprise a flexible tubing.

Advantageously, a ventilator associated with a drive motor can be omitted from the spinning or twisting machine. By this omission, the drive motor can be inexpensively constructed and its energy consumption reduced.

BRIEF DESCRIPTION OF THE DRAWING

The above and other objects, features and advantages of my invention will become more readily apparent from the following description, reference being made to the accompanying highly diagrammatic drawing, in which.

SPECIFIC DESCRIPTION

Figure 1:
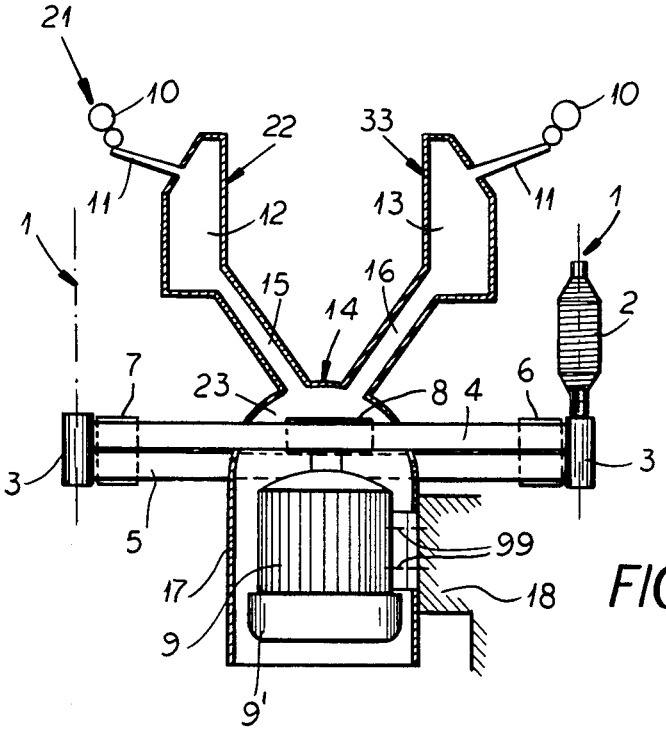
FIG. 1 is a side, elevational view, partly in section, of a spinning or twisting machine according to my invention, in which the air ducts and the heat collecting jacket are shown in cross section, but the operating units and drive motor are shown from the side.

A plurality of operating units 1 are mounted on each side of a first embodiment of a spinning or twisting machine, which is only schematically illustrated in FIG. 1. An operating unit 1 is, by definition, a machine component with a comparatively high rotational speed, for example, a spindle in a spinning or twisting machine, or a rotor and/or a disentangling or releasing roller in an OE (open ended) spinning machine.

This operating unit 1 can, as in the case at hand, comprise a spindle 2, which is driven by tangential belts 4 and 5 engaging whorls 3. These tangential belts 4 and/or 5 also run over guide roller elements 6 and/or 7 and over a drive wheel 8 driven by a drive motor 9.

Above the operating unit 1 a drawing frame 21 is found, whose rollers 10 are illustrated only schematically. Near each drafting frame 21 on each side of the spinning or twisting machine a front opening suction intake pipe 11 is located.

Each suction intake pipe 11 is connected to a respective main air duct 12 or 13. Main air duct 12 extends longitudinally on one side of the spinning or twisting frame, while main air duct 13 extends longitudinally on the opposite side of the spinning or twisting frame.

Each drive motor 9 is surrounded by a heat collecting jacket 14, which has a bulb or bell shaped top 23 connected to a cylindrical shaped body region 17. Heat generated in the motor 9 is collected in the cylindrical shaped region 17 and in the bell shaped top 23 of the heat collecting jacket 14, and is conducted by the connecting air ducts 15 and 16 to the main air ducts 12 and 13 respectively.

As a result, this drive motor 9 can be constructed without a ventilator—whereby a further saving results—or can be run with reduced ventilator power consumption. In the case of running with reduced ventilator power consumption the motor has a ventilator, which has a reduced air throughput. The air flow is directed through the heat collecting jacket 14 by the ventilator cover 9' and is conducted over the surfaces of the drive motor 9 before entering the previously mentioned main air duct 12 and 13. Thus a good cooling action occurs. The reduced ventilator power consumption may be attained with a smaller fan diameter or smaller fan blades.

Figure 4:
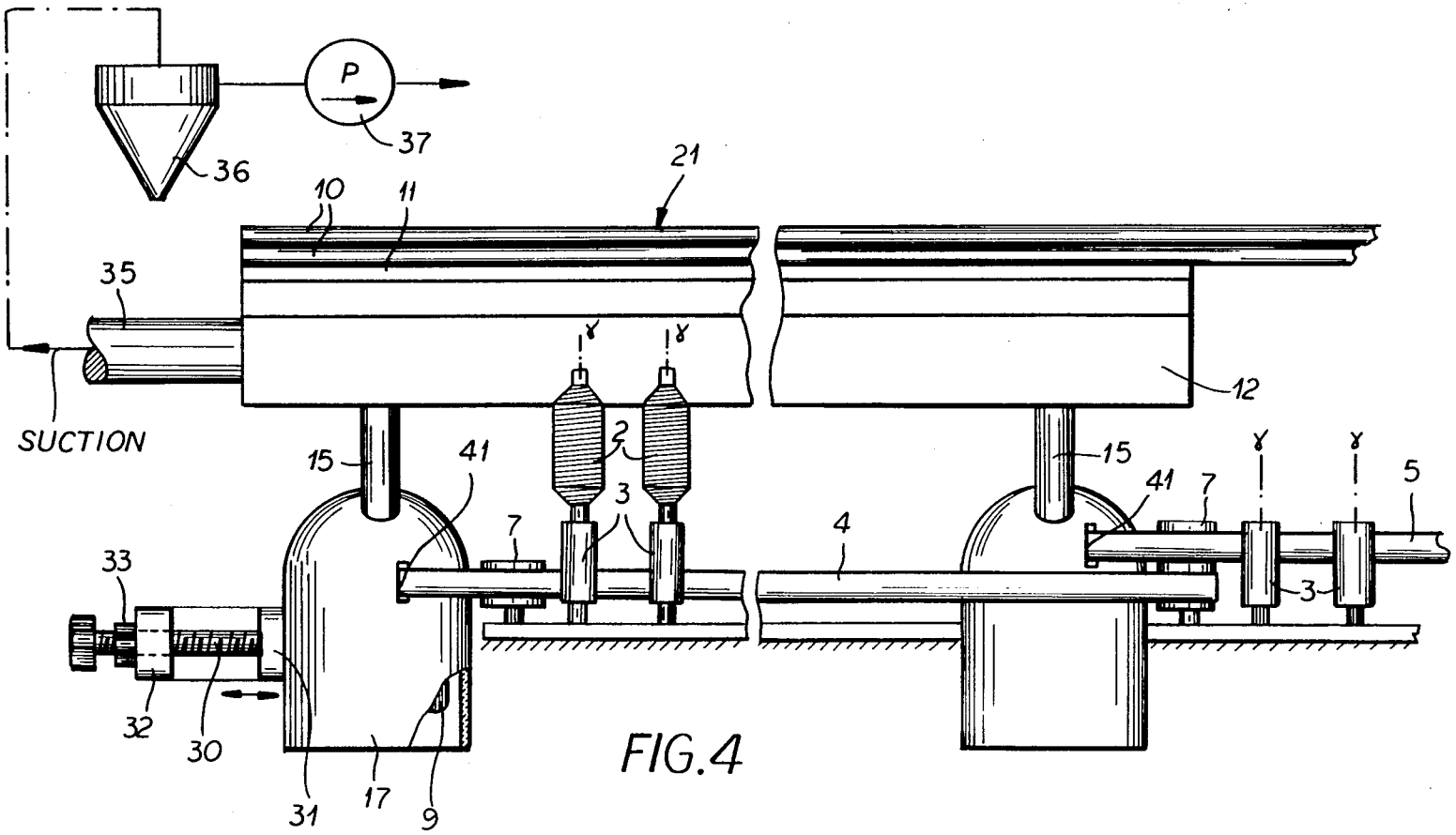
FIG. 4 is a front view, partly broken away, of the machine.

According to FIG. 1 the heat collecting jacket 14 is mounted over the drive motor 9 by attaching both to a frame 18, for example, by the screws 99 shown with dot-dashed lines in FIG. 1. The heat collecting jacket 17 and the drive motor 9 are movable perpendicular to the plane of FIG. 1 to provide an adjustment of the tension in the drive belts 4 and/or 5, e.g. by a threaded spindle 30 one end of which is connected to a block 31 connected rotatably to the jacket 17 and which is threaded into a support 32. The position can be locked by a nut 33 (FIG.4).

Figure 2:
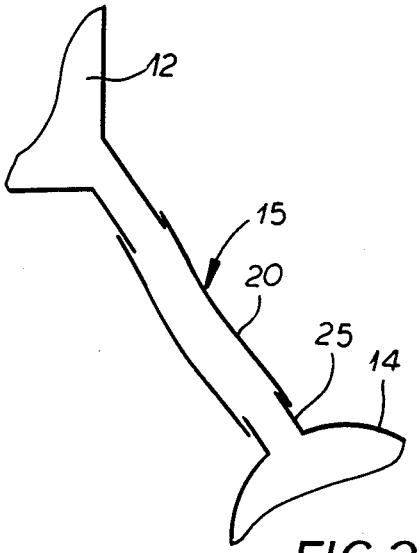
FIGS. 2 and 3 are cross sectional views of two different embodiments of the connecting air duct structure and the spinning or twisting machine according to my invention also showing part of the main air duct.

According to FIG. 2 in the first embodiment of my invention the heat collecting jacket 14 is connected by a flexible tubing 20 with the main air duct 12. Correspondingly, also main air duct 13 shown in FIG. 1 can be connected by a similarly formed tubing with the heat collecting jacket 14. This heat collecting jacket 14 has connectors 25, to which the tubing 20 can be connected or put on.

Figure 3:
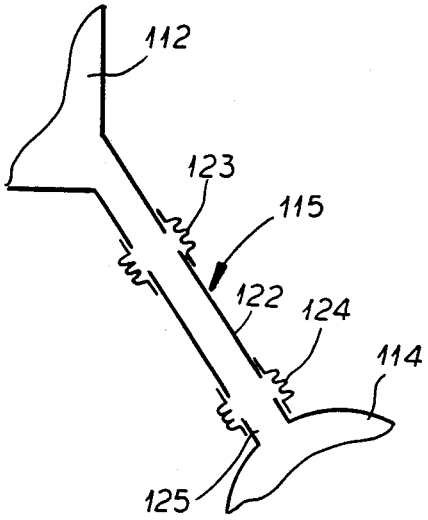

According to another second embodiment as shown in FIG. 3 the connecting air ducts 115 and/or 116 each comprise a rigid pipe 122 guided into two flexible coupling sleeves 123 and/or 124 provided for each end of the pipe 122. Again here connectors 125 are provided in suitable positions on the heat collection jacket 114 over which the flexible elastic coupling sleeves 124 are engaged. The balance of the second embodiment is identical to the embodiment of FIG. 1 and is not illustrated in detail herein.

Since the heat generated by the drive motor 9 is conducted through the connecting air ducts 15 and 16 into the main air ducts 12 and 13, the heat generated by the operating of the drive motor 9 is not transferred to the operating unit 1 in the first embodiment. This is also true of the second embodiment. A heating of adjacent machine components is therefore avoided. Furthermore, increased savings can be made by eliminating the ventilator fan completely.

The main ducts 12 and 13 can be evacuated via line 35 through the fiber and dust collecting cyclone 36 by the blower 37, these elements being normally present in a machine in which roving is sucked up in the event of failure.

My invention is also useful, when operating units 1 are drivable by several drive motors in a textile machine, and when transfer of heat generated by these motors to other machine parts or textile products should be avoided.

The heat collecting jacket 14 can comprise sheet metal, advantageously with a black-roughened inner surface, a heat insulating material (see FIG. 4), or contrastingly with a heat reflective inner surface.

For passage of the drive belts 4 and/or 5 the bell shaped top 23 of the heat collecting bell 14 is provided with suitable openings 41 (FIG. 4).

I claim:

1. A spinning machine comprising:

a spinning frame provided with:

a plurality of groups of upright spinning spindles having respective whorls and disposed in at least one row, respective drive belts tangentially engaging the whorls of each group for driving the respective spindles, and a respective electric motor having a vertical motor shaft for each of said groups drivingly coupled to the respective drive belt thereof;

a drafting frame above said spindles and provided with drafting rolls defining a drafting station at each spindle for drafting respective rovings to be fed to said spindles for spinning thereby, said drafting stations being arrayed along said row;

a suction duct extending all along said row above said spindles and formed with suction pipe fittings reaching from said duct toward each of said stations for sucking roving fragments into said duct;

a suction source connected with said duct for generating suction therein;

respective downwardly open bell shaped housings extending over each of said motors; and means connecting each of said housings to said duct at locations spaced therealong for drawing heat from said motors and preventing spinning variations at spindles of each group dependent upon the proximity of the respective spindles to the respective motor.

2. The spinning machine defined in claim 1 wherein each of said motors and the respective housing is mounted for movement parallel to said row to enable adjustment of the tension and the respective drive belt.

3. The spinning machine defined in claim 2 wherein said means connecting each of said housing to said duct includes a pipe and a pair of flexible coupling sleeves each connecting one end of said pipe to said duct, said ends of said pipe fitting into said sleeves.

4. The spinning machine defined in claim 3 wherein said spinning frame is provided with two such rows of spindles on opposite sides of said frame with each of said groups comprising spindles on both sides of said frame having whorls tangentially engaged by a common belt and driven by a respective motor, said drawing frame comprising respective sets of drawing rollers above each of said rolls to said ducts being provided, each having fittings extending toward the rollers of a respective set, said means connecting each of said housings to said duct including a pair of connecting pipes for each housing opening into the respective ducts.

* * * * *

UNITED STATES PATENT AND TRADEMARK OFFICE

CERTIFICATE OF CORRECTION

PATENT NO. : 4,679,389

DATED : 14 July 1987

INVENTOR(S) : Horst Wolf

It is certified that error appears in the above-identified patent and that said Letters Patent is hereby corrected as shown below:

In the heading, left hand column, item [73] please correct the assignee's city as follows:

Ebersbach-Fils

Signed and Sealed this

Third Day of March, 1992

*Attest:*

HARRY F. MANBECK, JR.

*Attesting Officer*

*Commissioner of Patents and Trademarks*